US007384085B2

(12) United States Patent
Steinhovden

(10) Patent No.: US 7,384,085 B2
(45) Date of Patent: Jun. 10, 2008

(54) RELEASABLE COUPLING DEVICE FOR LIFTING OBJECTS

(76) Inventor: Knut Ove Steinhovden, Høgevollstubben 14, Sandnes (NO) N-4327

( * ) Notice: Subject to any disclaimer, the term of this patent is extended or adjusted under 35 U.S.C. 154(b) by 0 days.

(21) Appl. No.: 10/276,749

(22) PCT Filed: May 4, 2001

(86) PCT No.: PCT/NO01/00186

§ 371 (c)(1),
(2), (4) Date: Apr. 22, 2003

(87) PCT Pub. No.: WO01/87761

PCT Pub. Date: Nov. 22, 2001

(65) Prior Publication Data

US 2003/0173792 A1 Sep. 18, 2003

(30) Foreign Application Priority Data

May 19, 2000 (NO) ..... 20002574

(51) Int. Cl.
*B25B 1/00* (2006.01)

(52) U.S. Cl. ..... 294/95

(58) Field of Classification Search .. 294/82.31–82.36, 294/82.24, 95, 97

See application file for complete search history.

(56) References Cited

U.S. PATENT DOCUMENTS 2,634,155 A * 4/1953 Frieder et al. ..... 294/82.32
2,823,379 A * 2/1958 Novak ..... 294/82.32
2,894,779 A * 7/1959 Kushner et al. ..... 294/82.32
3,039,811 A * 6/1962 Jones et al. ..... 294/82.32
3,738,693 A * 6/1973 Loustalet ..... 294/97
3,810,671 A * 5/1974 Jeffery ..... 294/82.32

(Continued)

FOREIGN PATENT DOCUMENTS

DE 1 531 184 4/1971

(Continued)

OTHER PUBLICATIONS

Derwent Abstract JP 11060145 (Liga) Mar. 2, 1999 Accession No. 1999-225787.

(Continued)

*Primary Examiner*—Saul J. Rodriguez
*Assistant Examiner*—Paul T Chin
(74) *Attorney, Agent, or Firm*—Andrus, Sceales, Starke & Sawall, LLP

(57) ABSTRACT

A releasable coupling device, especially for use in lifting devices has one or more couplings (3) that are arranged in the lifting equipment (2) or between the lifting equipment (2) and the load (1). The coupling is locked or opened directly or indirectly through a positional or rotational change of a locking element (23), which is brought about directly or indirectly by the buoyancy of a floating element (36) or other external force applied. Structural change of one or more metals may be used directly or indirectly to change the position of a release-blocking/locking element (39, 45) between a locked and an unlocked position. This structural change allows imitation through cableless remote control by the use of auxiliary equipment of a known type. Memory metal(s) can be used to change the position of the release-blocking/locking element (39, 45) between a locked and an unlocked position.

9 Claims, 15 Drawing Sheets

U.S. PATENT DOCUMENTS

| | | | | | |
|---|---|---|---|---|---|
| 3,811,720 | A | * | 5/1974 | Epstein | 294/82.34 |
| 3,950,020 | A | * | 4/1976 | Hoffmeister | 294/906 |
| 4,149,746 | A | | 4/1979 | Androski | |
| 4,202,727 | A | * | 5/1980 | Batjukov et al. | 294/906 |
| 4,236,967 | A | * | 12/1980 | Batjukov et al. | 294/906 |
| 4,244,616 | A | * | 1/1981 | Buchalet | 294/95 |
| 4,253,695 | A | * | 3/1981 | Blaive et al. | 294/95 |
| 4,258,888 | A | * | 3/1981 | Sawn | 294/82.32 |
| 4,340,249 | A | * | 7/1982 | Bucklew | 294/95 |
| 4,362,692 | A | * | 12/1982 | Greenaway | 294/95 |
| 4,859,117 | A | * | 8/1989 | Brandi et al. | 405/224 |
| 5,083,352 | A | * | 1/1992 | Nakako | 294/86.4 |
| 5,499,013 | A | * | 3/1996 | Konotchick | 340/539.22 |

FOREIGN PATENT DOCUMENTS

| | | | | |
|---|---|---|---|---|
| DE | 31 24816 | | 6/1982 | |
| JP | 359043792 | * | 3/1984 | 294/95 |
| NO | 840138 | | 7/1985 | |
| NO | 952889 | | 11/1995 | |
| SE | 355791 | | 5/1973 | |

OTHER PUBLICATIONS

Derwent Abstract JP 9317712 (Tokyo Kizai Kogyo KK), Accession No. 1998-084129.

* cited by examiner

RELEASABLE COUPLING DEVICE FOR LIFTING OBJECTS

This invention relates to a releasable locking device, especially for use in lifting devices, in which a simple and reliable mechanism for the disconnection of heavy packages is essential, as for example when modules are being positioned in underwater installations. The invention includes the application of memory metals in such devices.

In lifting operations under water, there are used, besides the common connecting links such as shackles and drop-out hook couplings, also couplings of the "collar lock" type. Both the collar lock and the drop-out hook coupling are quick release coupling types, which can be locked or released through simple operations.

A collar lock is formed to grip around a cylindrical portion in which there is arranged a collar at the free end portion thereof. The collar lock is provided with a bore of a diameter adapted to the diameter of the collar, so that it can be slipped over the collar. At a suitable distance from the end portion of the collar lock, there are arranged in the bore two cylindrical countersunk hollows formed as steps of different depths. The shallower countersunk hollow nearer to the end portion of the collar lock forms the locking hollow. A sleeve, whose locking end portion has a cylinder-shaped bead, is positioned in the bore. The locking end of the sleeve is split axially into many segments, so that the locking end of the sleeve consists of many "fingers", each of them with part of the cylindrical bead placed at its free end portion. The geometry of the bead at the inner surface of the sleeve matches the collar complementarily, whereas the geometry at the external surface of the sleeve complementarily matches the countersunk hollow nearer to the end portion of the bore.

Prior to connection, the sleeve is carried into such a position that the beads of the sleeve have an axial position in the bore which coincides with the deeper countersunk hollow positioned within the countersunk hollow which the beads lock into. Because this countersunk hollow is deeper, the fingers can pivot into it when they are passed over the collar. By the spring force of the fingers the beads at the inner portion of the sleeve (and fingers) will be positioned behind the collar. The collar coupling housing is then carried axially relative to the sleeve, so that the beads at the outer portion of the sleeve are positioned in the countersunk hollow, in which the beads are locked and thereby prevented from moving out from the collar. As the coupling is released, load is removed therefrom, and the collar coupling housing is carried axially relative to the sleeve into a position, in which the beads of the outer portion of the sleeve are positioned over the deeper countersunk hollow, so that they can pivot into it when the sleeve is pulled out over the collar.

In a drop-out hook coupling a load-carrying hook is connected at one end to a housing by means of a hinge. In a bore in the housing is positioned a locking spindle. The housing is provided with an internal threaded portion for attachment to the lifting equipment. The locking spindle, which can be displaced axially in the bore of the housing, is arranged to be placed, in its locked position, in a locking hole in the drop-out hook. The drop-out hook coupling is opened in that the locking spindle is displaced out of the hole of the hook, after which the hook may pivot about the hinge and release the load hanging on the hook.

Both types of quick release couplings can be manoeuvred by actuator.

In work under water the connection links must be operated by a diver or an ROV (Remote-Operated Vehicle).

Alternatively the types of quick release couplings can be operated from the sea surface, by for example a hydraulic connection from an aggregate on a ship to an actuator in the coupling.

The object of the invention is to supplement existing equipment, the new technique making use of a novel coupling of the multi-dog type, in which a floating element, or other locally appearing force, can be used to operate a locking element of the coupling. The coupling is provided with a release-blocking element, which secures it against inadvertent release. To move the blocking element between the locked and unlocked positions, a power element is used, in which the power is produced through a phase change in a memory metal. Thereby the invention enables the use of simple and functionally reliable remote-control equipment.

A coupling of the multi-dog type according to the invention, has, for example, an outer paret (the female part) with a bore, in the cylindrical surface of which there is arranged one or more annular countersunk hollows. The coupling parts are also provided with a securing device each for connection to a load or a piece of lifting equipment. The inner part (male part) of the coupling is formed so, that a cylindrical portion of it can be inserted into the bore of the outer part. In this cylindrical portion are arranged two or more axial slots, wherein a locking dog is suspended resiliently on a hinge shaft in each slot, so that within a limited sector it may pivot in and out towards/from the centre line of the coupling. In a loaded state the locking dogs will rest on the bottom of the axial slot, whereas in the unloaded state they will spring back and have a clearance from the bottom of the axial slot. The clearance can be adjusted through, e.g., an adjustment screw located in the locking dog and tightening against the hinge shaft. A locking body may be inserted into a bore, in between the locking dogs when they are in a locked position, pivoted outwards. The locking body may be connected to each locking dog by means of a chain link, but the locking body will also work without this mechanical connection. The chain link is hingingly suspended from both end portions, and at the end portion facing the locking dog it is provided with an oval groove for a link axle. A spring or mass acts on the locking body in a direction towards the locked position.

When the two main parts of the coupling are being brought together, the locking body is positioned outside its locking positions so that the locking dogs at the chain links can be retracted to a swung-in released position. The inner part of the coupling may thereby be inserted into the outer part of the coupling. When the coupling parts are in correct relative connecting positions, the locking body may be pushed into the locked position while at the same time the locking dogs pivot outwards into engagement in the countersunk hollows of the outer part. Thereby the coupling forms a fixed mechanical connection.

Releasing of the coupling can take place in that the locking body is carried out its locking position, while at the same time the locking dogs are pivoted inwards, out of the countersunk hollows of the outer coupling. The link axle being position with clearance in the oval groove of the chain link, there is no "over centre" function between the locking body, the chain links and the locking dogs. Thereby, having to move the locking dogs further outwards before release can occur, is avoided. The inner part of the coupling may then be pulled out of the outer part.

The locking body is connected to a device which is arranged to apply the necessary force to the locking body to move it, thereby releasing the coupling. The releasing force may come from a floating element or other power unit, for example an underwater vehicle, a so-called ROV, or a diver.

The coupling is provided with a release-blocking element in order to release the connection between the coupling parts. The release-blocking element comprises a blocking spindle, which is positioned in its locked position in a locking groove, a conventional spring and a memory metal spring. According to the invention the locking spindle is suspended between two types of springs, which pull or push the locking element in opposite directions. In this connection a spring may consist of several springs or spring systems. In a preferred embodiment the force of a conventional spring will act on the locking spindle in a direction towards the locked position, whereas the force of a memory metal spring will work in the opposite direction.

The memory effect of the memory metal may be explained as the material appearing in two different structural phases. In its cold state the material has an easily mouldable martensite structure, with a yield strength of e.g. about 70 MPa, and above the transformation limit an austenite structure with a yield strength of e.g. about 210 MPa. By a change in the proportion of mixture of e.g. nickel and titanium in the memory metal alloy, the temperature of transformation between the martensite and austenite structures may be kept in the range from −100° C. to +100° C. Memory metals are also known, which may have two positions, depending on the temperature, without mechanical influence, i.e. the metal adopts one geometry under the influence of heat and another geometry when the metal is cooled. Memory metals are well known in themselves and are commonly available, and therefore are not an object of this patent application.

When the locking groove is in the locking position relative to the locking spindle, the ordinary spring, which affects the locking spindle and has a greater tension than that of the memory metal spring which is in its cold state, will overcome the force of the memory metal spring and push the locking spindle into locked position. When the coupling is to be released, the memory metal is heated. The structure is then changed into the mechanically strong austenite state. The increased force of the memory metal springs is sufficient to overcome the force of the ordinary spring. Thereby the locking spindle is carried out of the locking groove, the floating element may then pull the locking body out of its locking position in order thereby to pull the locking dogs in towards the centre of the coupling and thus release the mechanical connection between the coupling parts. To secure the coupling against inadvertent release, release blocks may be arranged at several levels, for example in that a release-blocking element locks another release-blocking element, the latter being arranged to release the floating element itself.

A further development of the invention consists in the arrangement of a manoeuvring/battery pack at the coupling, which is connected to the memory metal springs. This unit can be controlled for example from the sea surface by the use of known radio/sonar technique. Warm liquid and/or chemical energy in the form of reaction heat from two or more materials can also be used as a heat source.

In the following there will be described several non-limiting examples of preferred embodiments, which are visualized in the accompanying drawings, in which.

Figure 1:
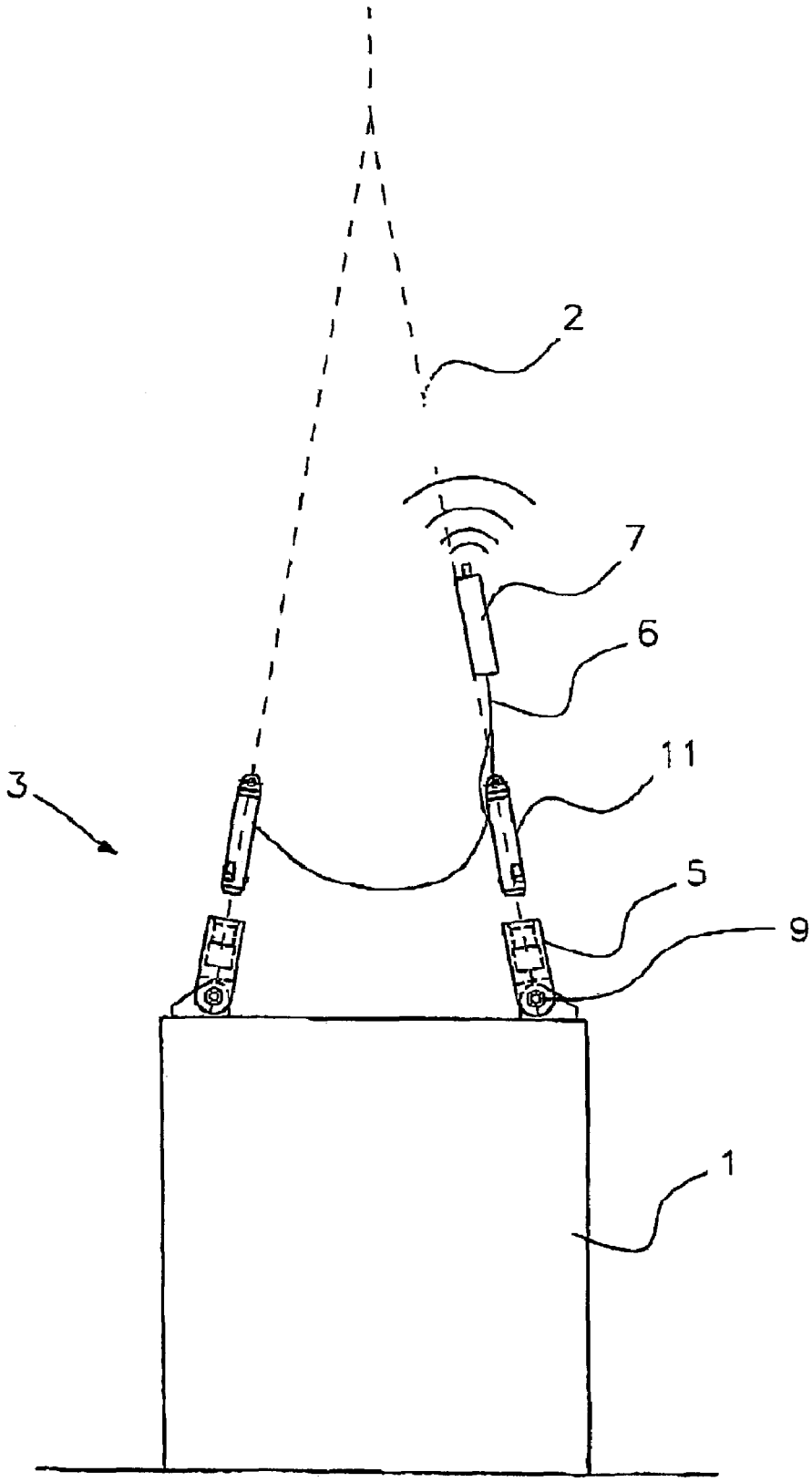
FIG. 1 is a principle drawing showing the main components included in a releasable lifting arrangement according to the invention, wherein the main parts such as load, couplings, lifting equipment and manoeuvring/battery pack are shown.
Figure 2:
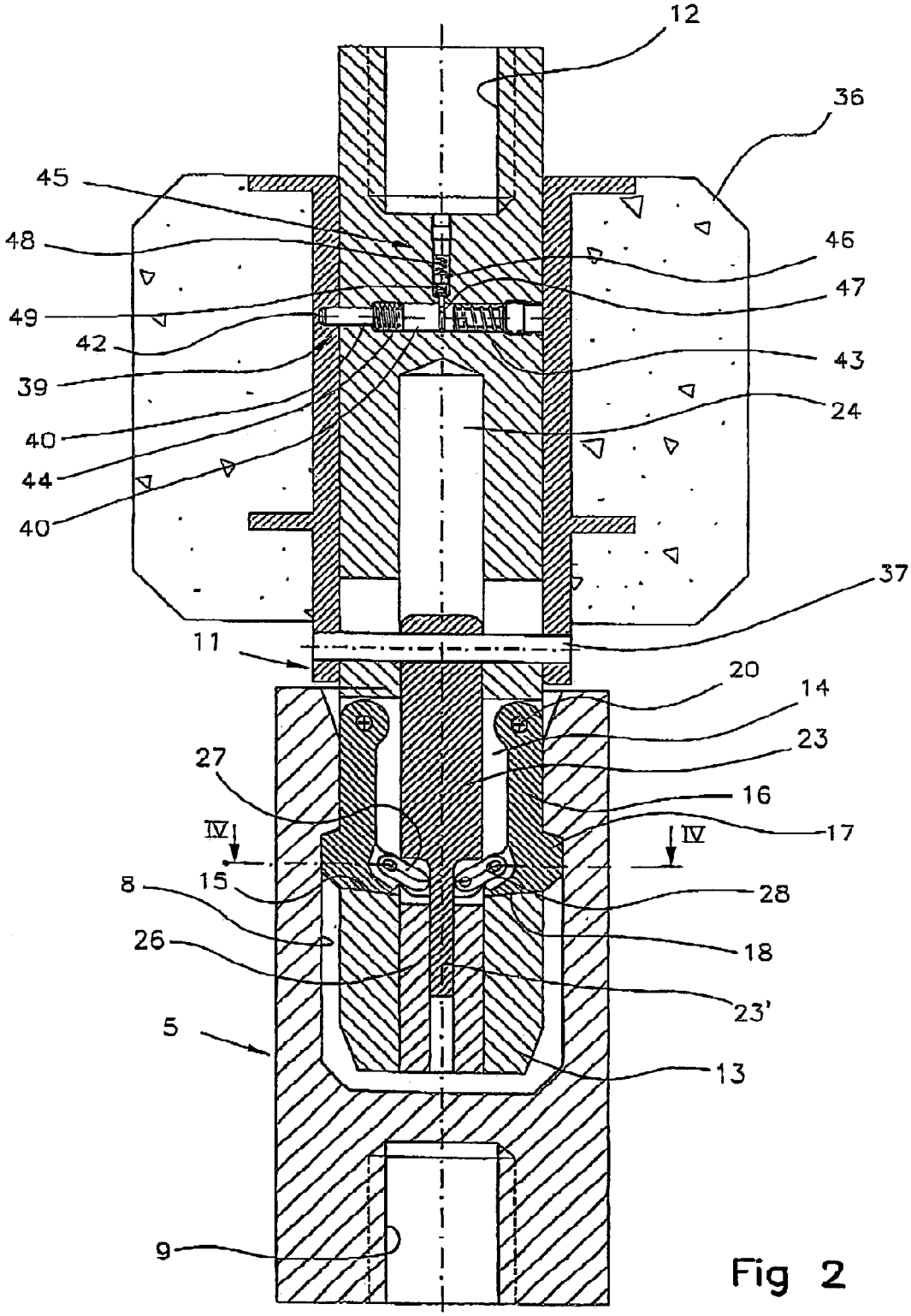
FIG. 2 shows, in a section, an embodiment of the invention in a multi-dog coupling, the release force coming from a floating element arranged concentrically relative to the coupling, the inner part of the coupling being locked in the outer part of the coupling.
Figure 5:
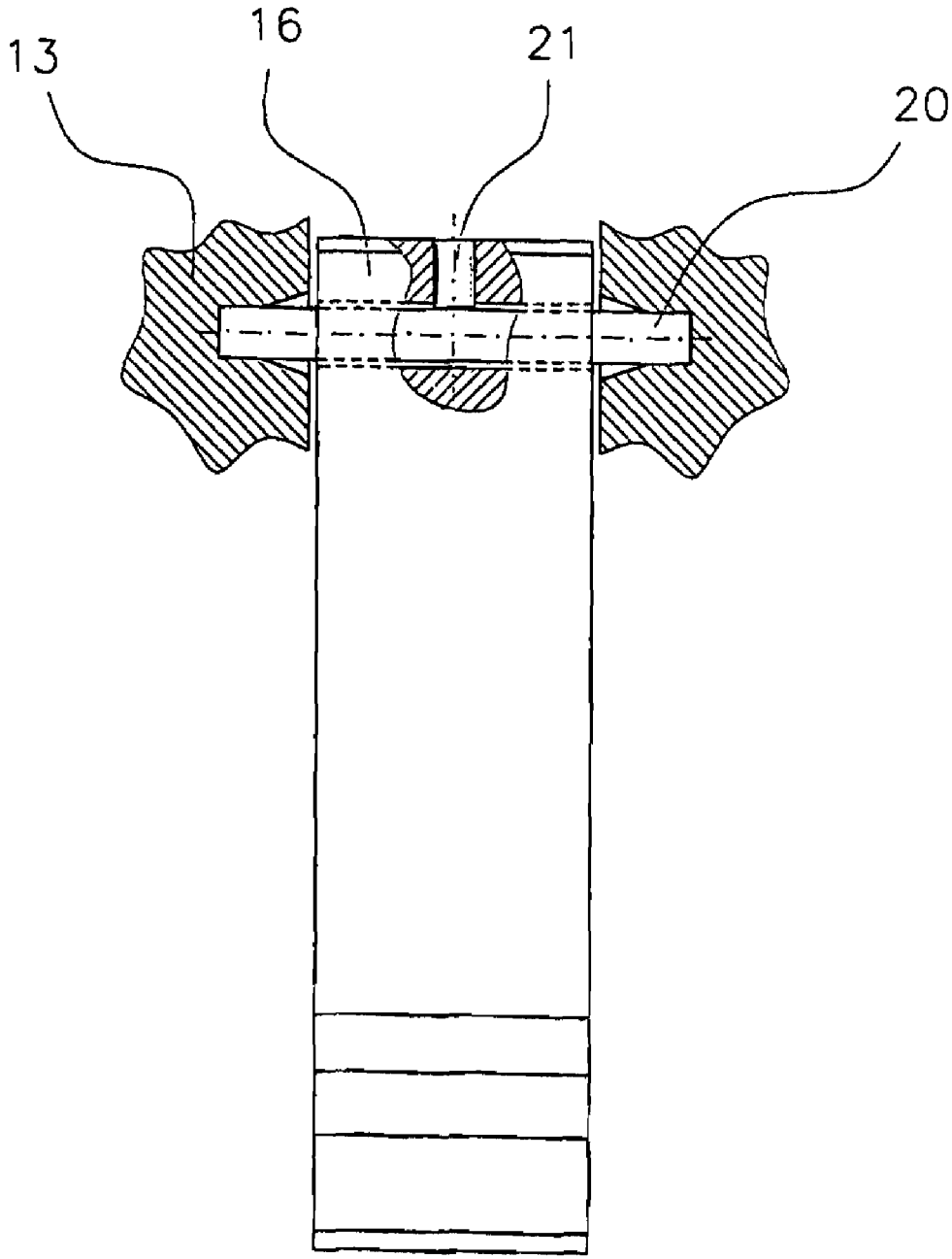
FIG. 5 shows in a front view, partly in section, details of the suspension of the locking dog (see FIG. 2)
Figure 6:
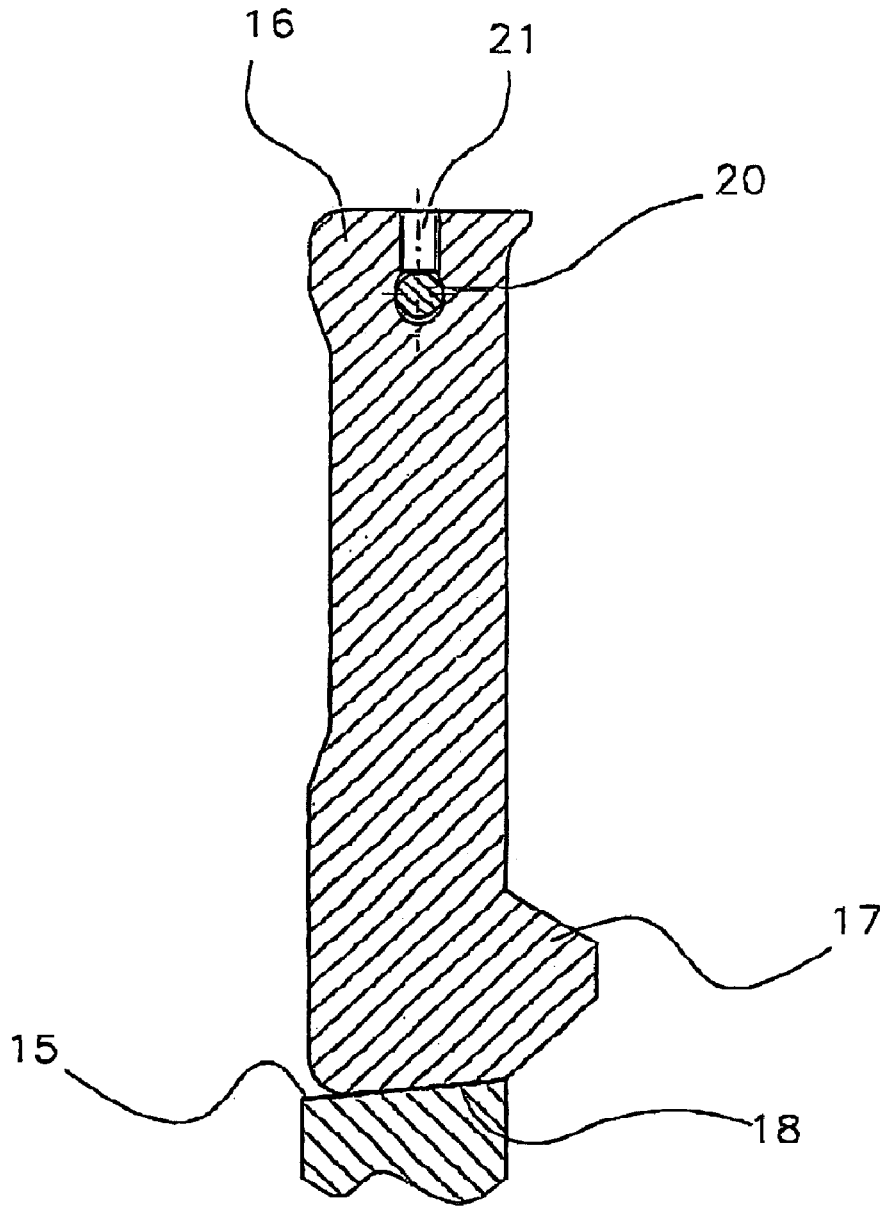
FIG. 6 shows in a side view, partly in section, details of the suspension of the locking dog (see FIG. 2)

In FIG. 1 the reference numeral 1 identifies a load which is to be positioned and then disconnected from a piece of lifting equipment 2. A remote-controlled multi-dog coupling 3 in the form of an outer part 5 and an inner part 11 is connected through a wire 6 to a manoeuvring/battery pack 7 controlled by a transmitter not shown. The coupling parts 5 and 11 are shown here in a disconnected state. The mounting elements 9 and 12, respectively, FIG. 2, are arranged to connect the coupling parts 5 and 11, respectively, to the lifting equipment 2. The outer part 5 of the coupling is provided internally with one or more annular countersunk hollows 8. In each of one or more longitudinal slots 14 in the inner part 11 of the coupling is arranged a locking dog 16. The locking dog 16 is provided with one or more locking teeth 17 and is suspended from a hinge shaft 20, and the locking dog 16 is arranged to pivot on this hinge shaft 20 between an inner unlocked position and an outer locked position. The lifting power is transferred from the outer part 5 of the coupling through the teeth 17 of the locking dogs 16 positioned in the countersunk hollows 8, to a bearing is surface 15 at the lower end of the slots 14. The locking dogs 16 are prevented from pivoting out of the locking position by a displaceable locking body 23 positioned in a bore 24 of the inner part 11 of the coupling. The locking dogs 16 are provided with an adjusting screw 21 (see FIGS. 5 and 6) bearing on the hinge shaft 20. The adjusting screw 21 is arranged to adjust the distance between a bearing surface 18 at the end portion of the locking dog 16 and a bearing surface 15 of the slot 14 when the coupling is unloaded. Lack of mechanical contact at the bearing surfaces 15 and 18 causes the locking dog 16 to pivot more easily about the hinge shaft 20. When the locking dog 16 is stressed, the hinge shaft 20 springs so that the bearing surface 18 of the locking dog 16 bears on the bearing surface 15 of the slot 14. By suitable sizing of the hinge shaft 20 a predetermined portion of the load on the locking dogs 16 could be absorbed by the inner part 11 of the coupling through the hinge shaft 20.

Figure 4:
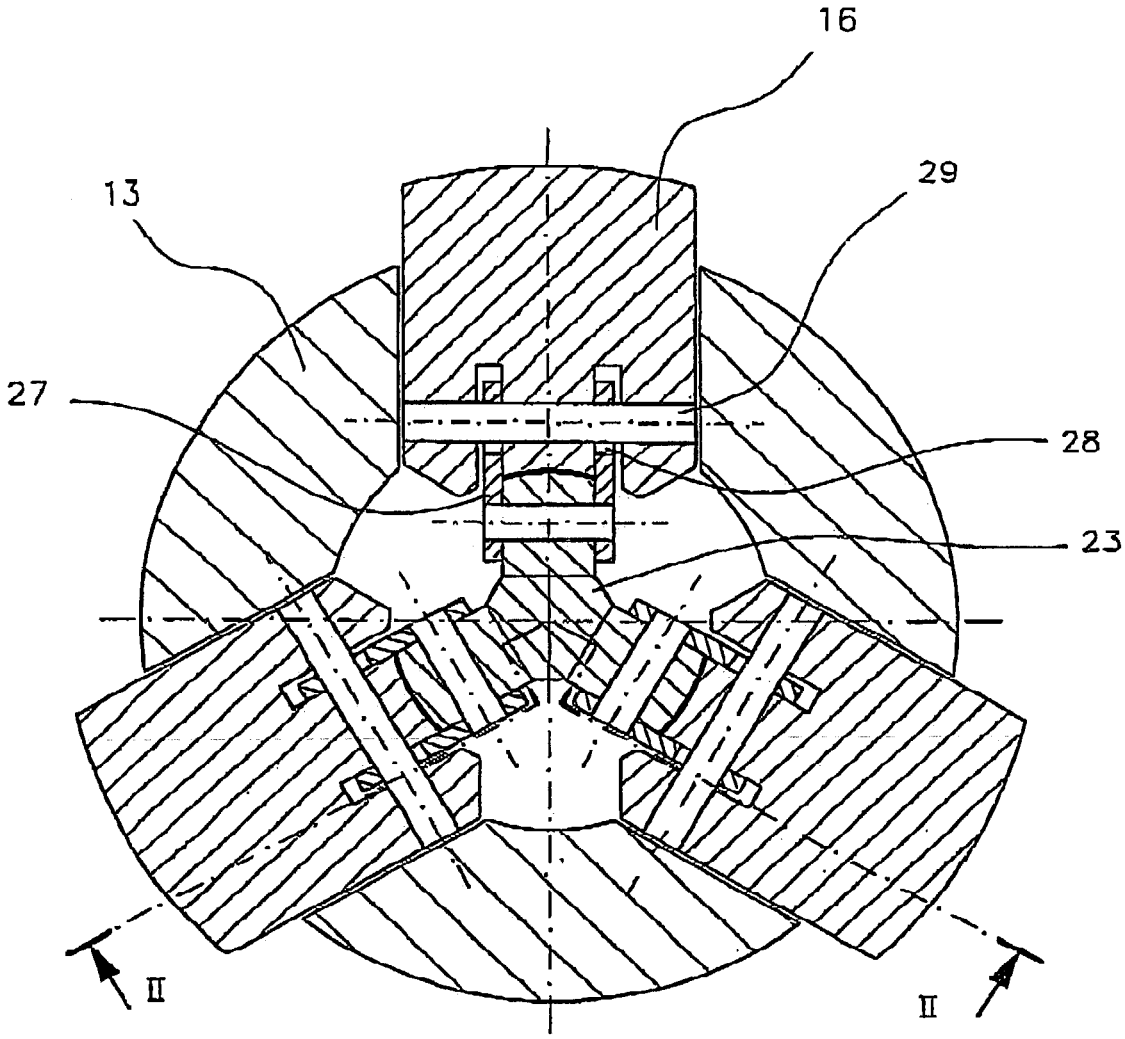
FIG. 4 shows the coupling of FIG. 2, seen in a section IV-IV across the longitudinal direction, through the locking dogs, the chain links and the locking body (Only the inner part of the coupling is shown.)

In the bore 24 the inner part 11 of the coupling is provided with a guide sleeve 26, in which the lower end portion 23' of the locking body 23 is arranged to be displaceable longitudinally of the coupling 3. In this preferred embodiment each looking dog 16 and the locking body 23 are connected to a chain link 27. The purpose of the chain links 27 is that when the locking body 23 is being displaced from its locking position, the locking dogs 16 should at the same time pivot inwards towards their idle positions. A link axle 29 (see FIG. 4) being taken through an oval groove 28, the chain link is arranged to transfer only tensile forces, whereas compressive forces between the locking dogs 16 and the locking body 23 are transferred in the contact surface between the parts.

A floating element 36 is arranged concentrically about the inner part 11 of the coupling and connected to the locking body 23 through an axle 37. The inner part 11 of the coupling is provided with a release-blocking element 39, in which a blocking spindle 40 is positioned, in its locked position, in a locking groove 42 in the floating element 36. A conventional spring 43 forces the locking spindle 40 in the direction of its locked position and overcomes the force of a memory metal spring 44 which is forcing the blocking spindle 40 in the opposite direction. The coupling is provided with a secondary release-blocking element 45 arranged to lock the release-blocking element 39 in a locking groove 47, thereby preventing inadvertent release of the coupling. The secondary release-blocking element 45 is provided with a blocking spindle 46, a conventional spring 48, a memory metal spring 49, and is identical to the release-blocking element 39 in configuration and operation.

When the coupling is to be released, the memory metal spring 49 of the secondary release-blocking element 45 is first heated to a temperature above the structural transformation temperature. The heating can be achieved for example in that electrical current is induced to flow through the memory metal spring 49 through not shown wires. The memory metal spring 49 now adopts strong austenite phases overcomes the force of the conventional spring 48 and moves the blocking spindle 46 out of its locking position. The memory metal spring 44 of the release-blocking element 39 is then heated and, in the same manner, carries the blocking spindle 40 out of the locking groove 42. The buoyancy forces acting on the floating element 36 moves the floating element, which is no longer locked, upwards, thereby carrying the locking body 23 by way of the axle 37 out of its locked position. Simultaneously the locking dogs 16 pivot inwards towards their free positions, and the inner part 11 of the coupling will be lifted by the buoyancy forces acting on the floating body 36 out of the outer part 5 of the coupling.

Figure 7:
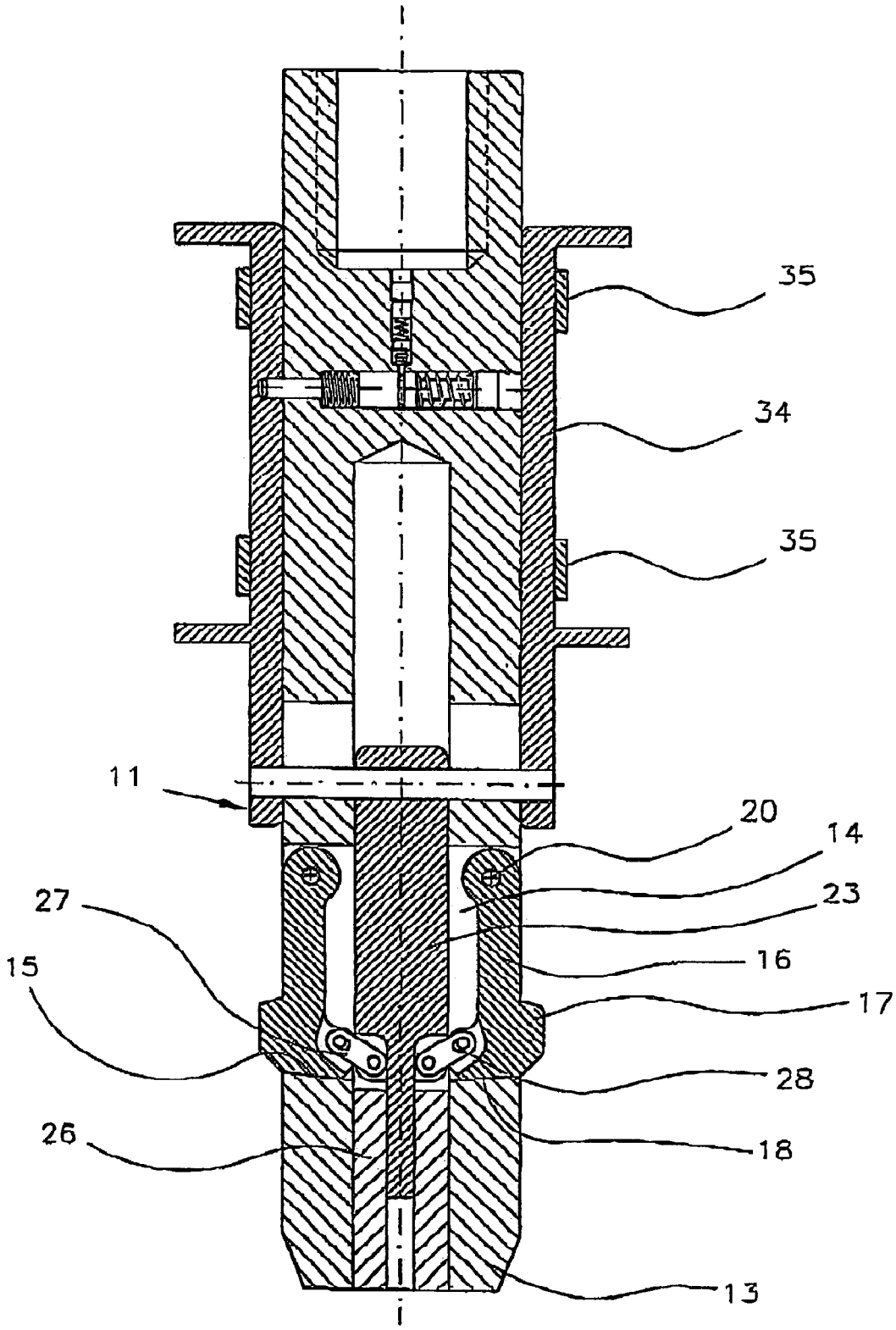
FIG. 7 shows, in a section, an embodiment of the invention in a multi-dog coupling provided with a grip ring. The grip ring is connected to the locking body and is arranged to be displaced by an ROV in order to release the coupling.

The floating element 36 may be replaced for example by a grip sleeve 34, see FIG. 7, which may be provided with two contact rings 35. An external force, for example from an ROV, may displace the grip sleeve 34 and thereby release the coupling 3. As the sleeve 34 is gripped, the contact rings 35 are short-circuited so that electrical current is carried through wires, not shown, to the memory metal springs 44 and 49 of the release blocks 39, 45.

Figure 3:
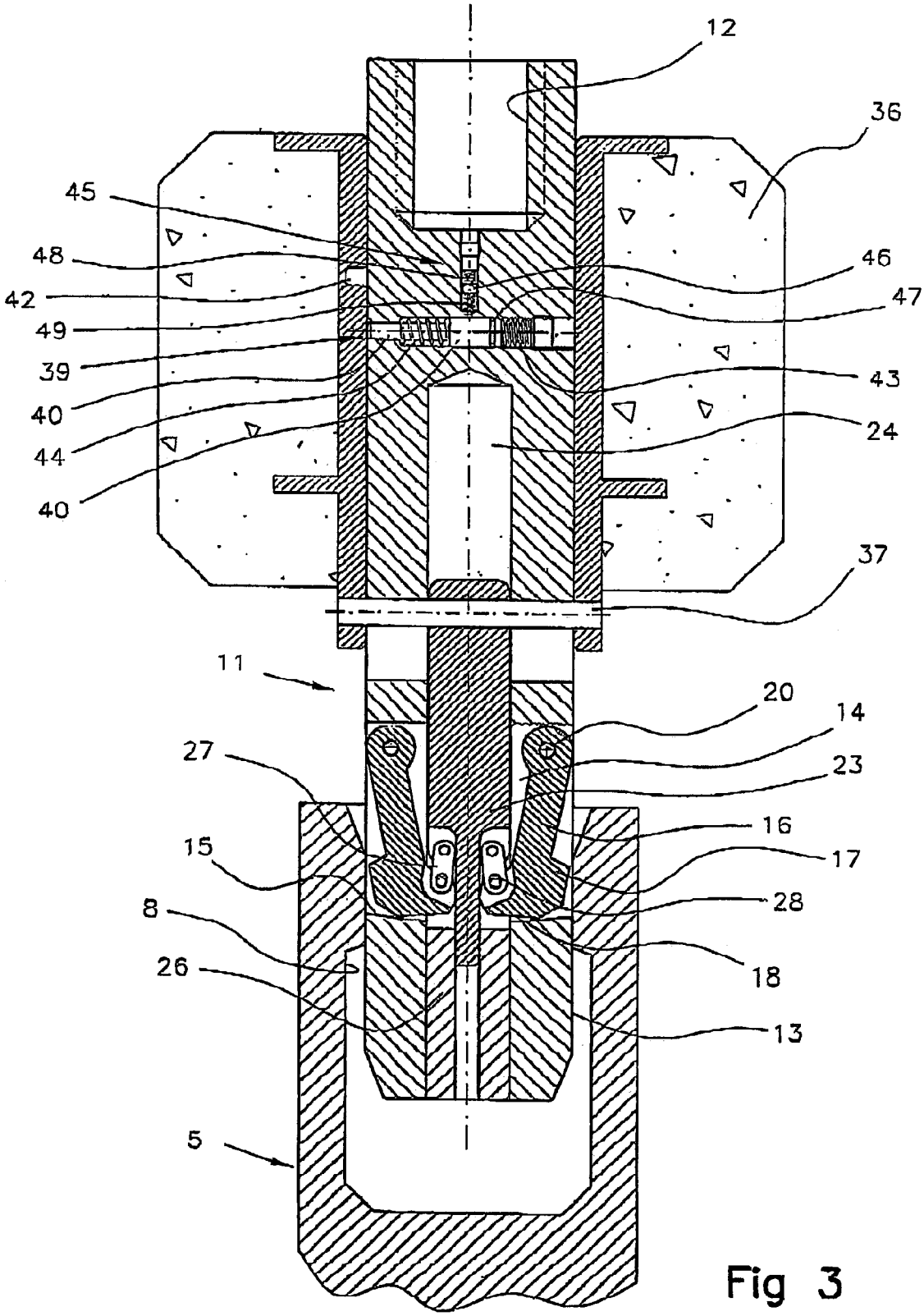
FIG. 3 Shows, in a section, an embodiment of the invention in a multi-dog coupling, the release force coming from a floating element arranged concentrically relative to the coupling, the inner part of the coupling having been released and partly pulled out of the outer part of the coupling.
Figure 8:
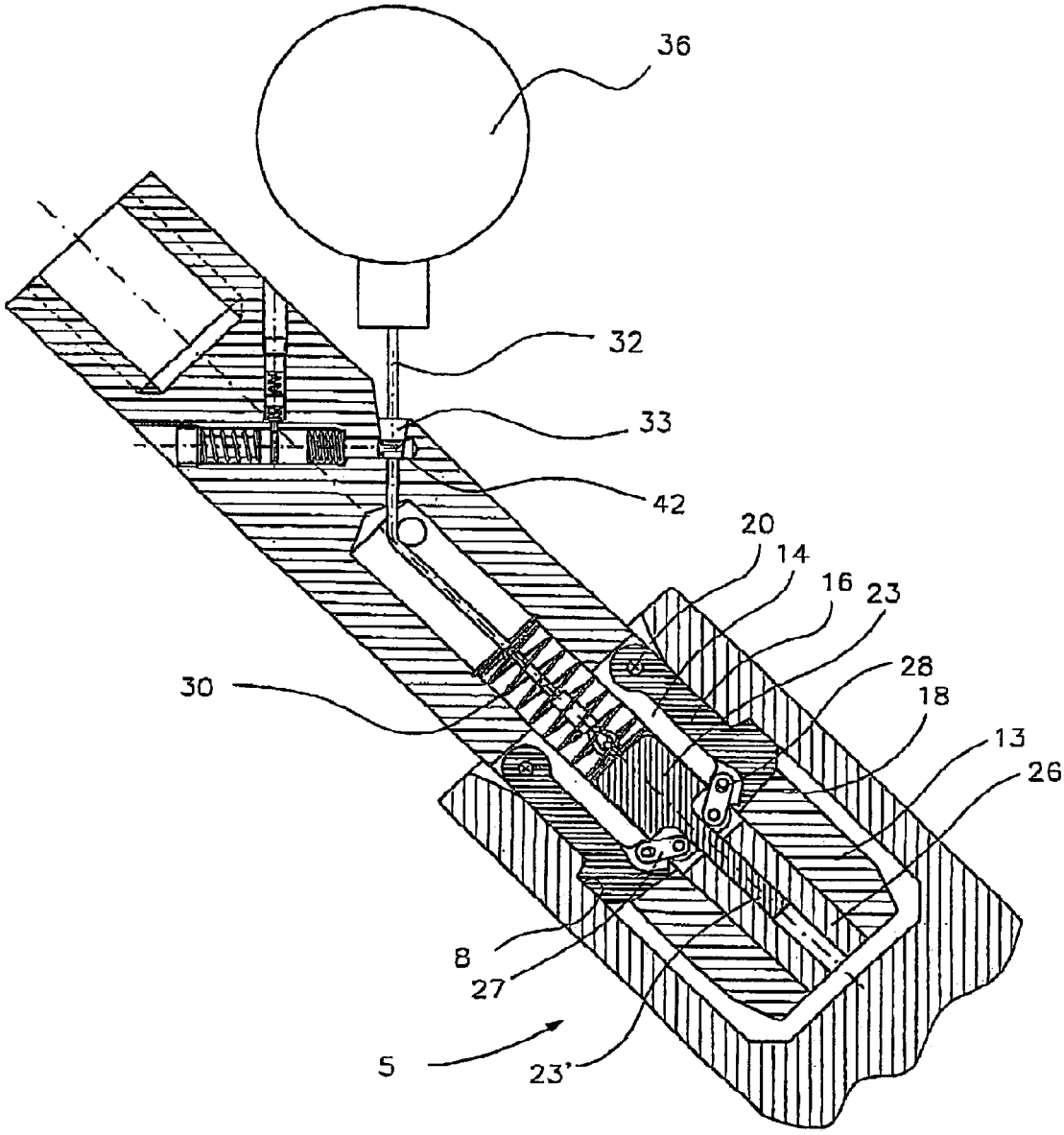
FIG. 8 shows, in a section, an embodiment of the invention in a multi-dog coupling, the release force coming from a floating element arranged to the side of the coupling, the inner part of the coupling being locked in the outer part of the coupling.
Figure 9:
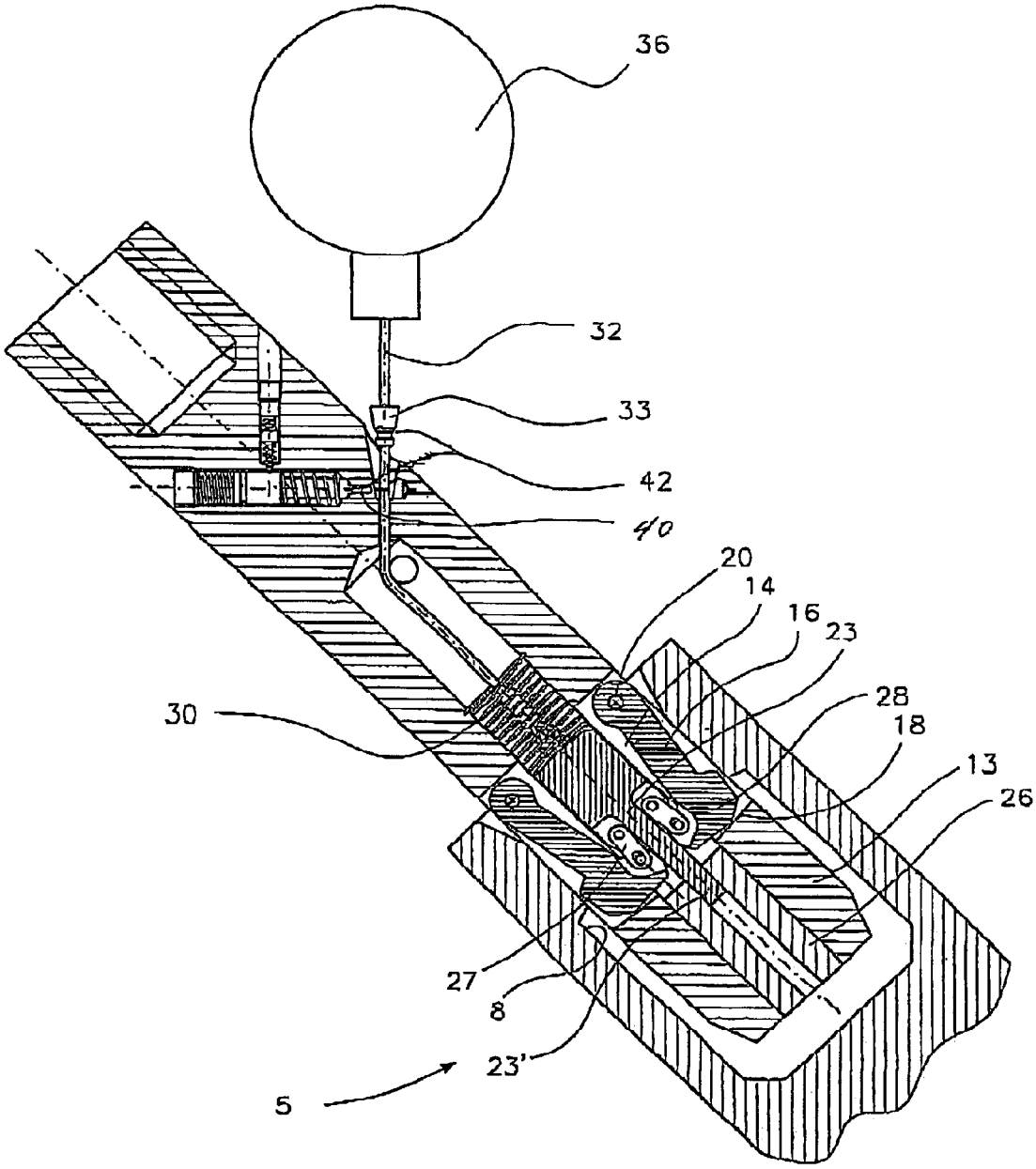
FIG. 9 shows, in a section, an embodiment of the invention in a multi-dog coupling, the release force coming from a floating element arranged to the side of the coupling, the inner part of the coupling having been released and partly pulled out of the outer part of the coupling.
Figure 10:
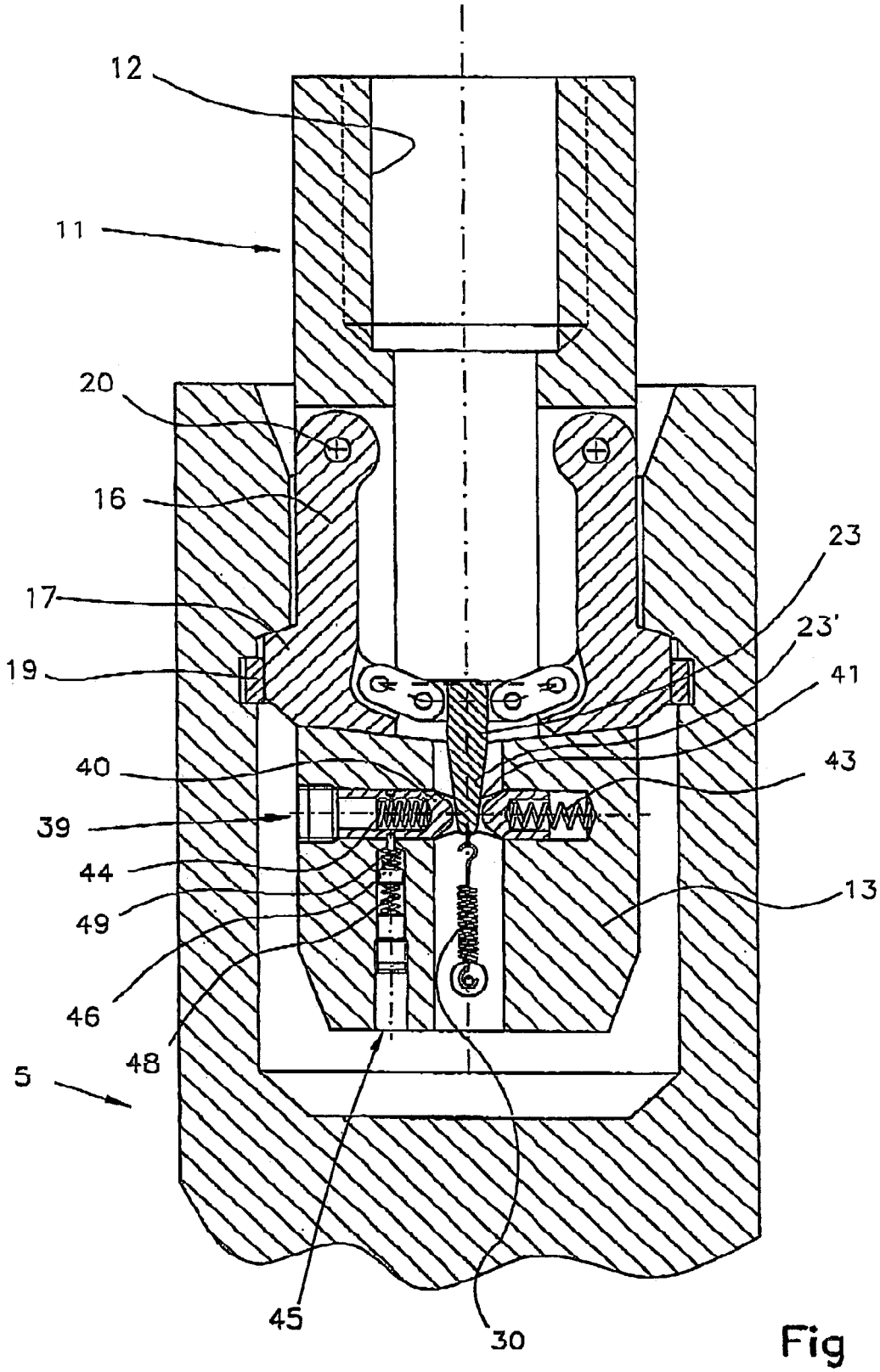
FIG. 10 shows, in a section, an embodiment of the invention in a multi-dog coupling, wherein the locking body is also arranged to work as a lever in addition to being axially movable. The figure shows the inner part of the coupling in its locked state.
Figure 11:
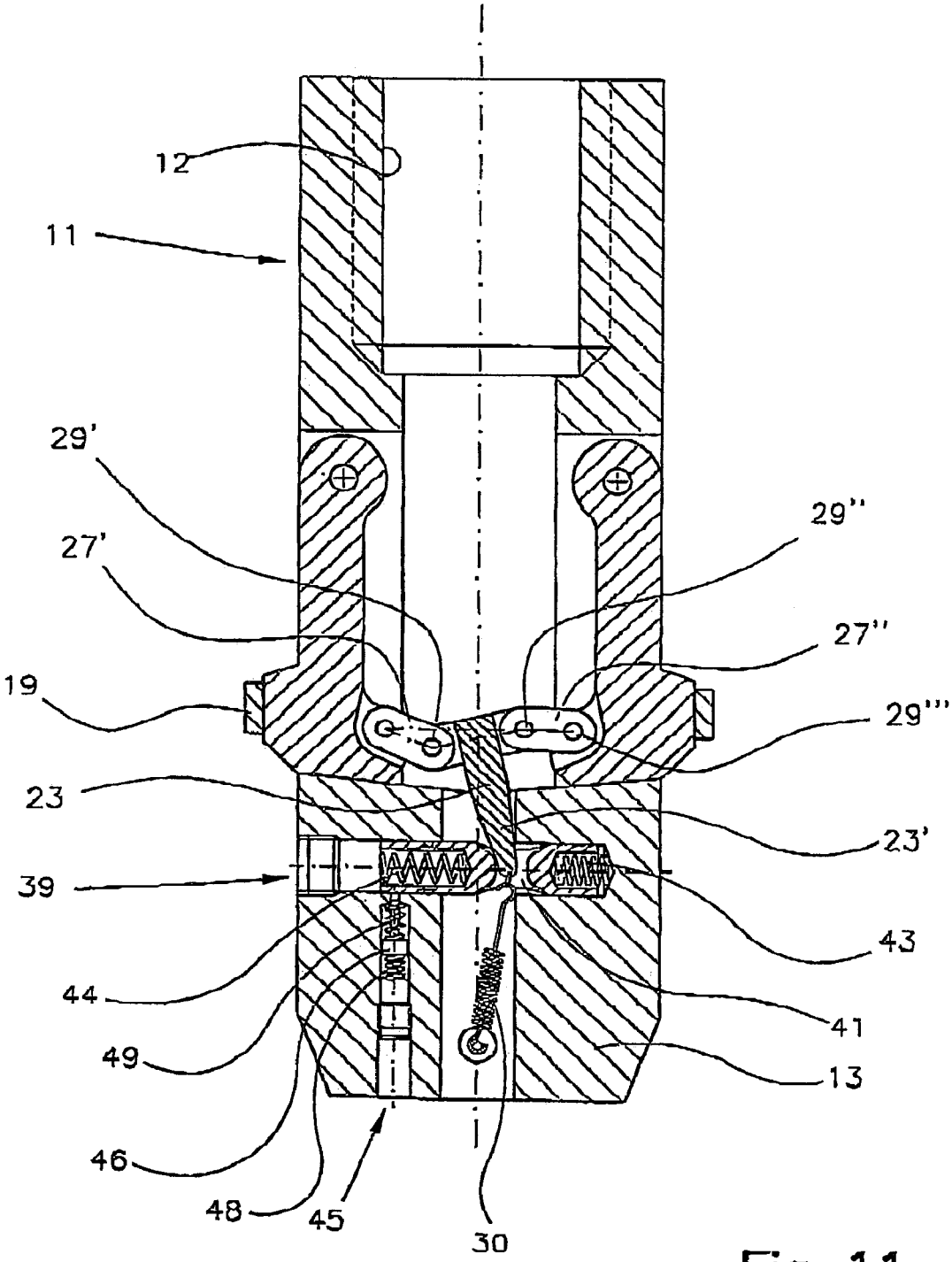
FIG. 11 shows, in a section, the coupling of FIG. 10 in the first phase of release.
Figure 12:
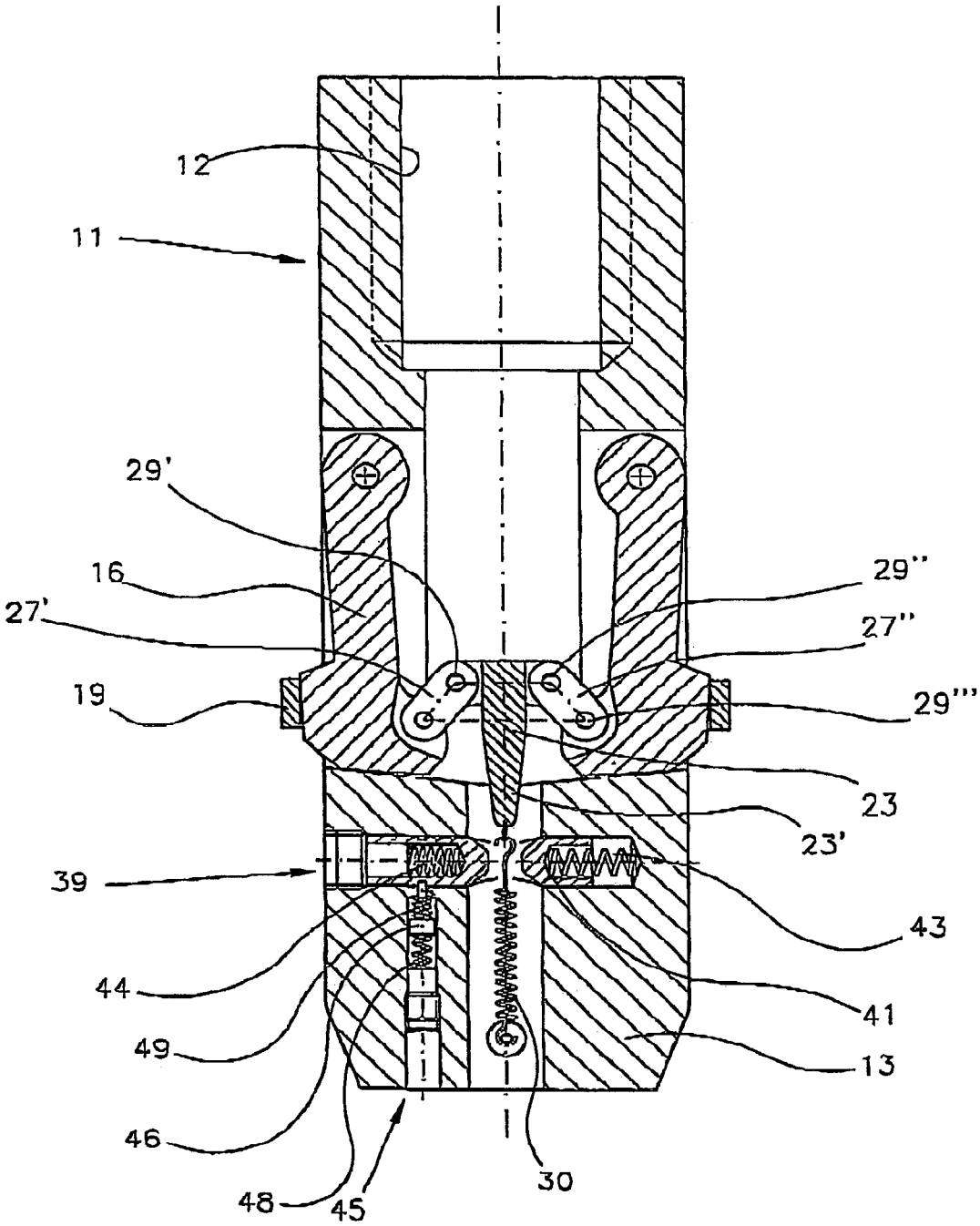
FIG. 12 shows, in a section, the coupling of FIG. 10 in a second phase of release.
Figure 13:
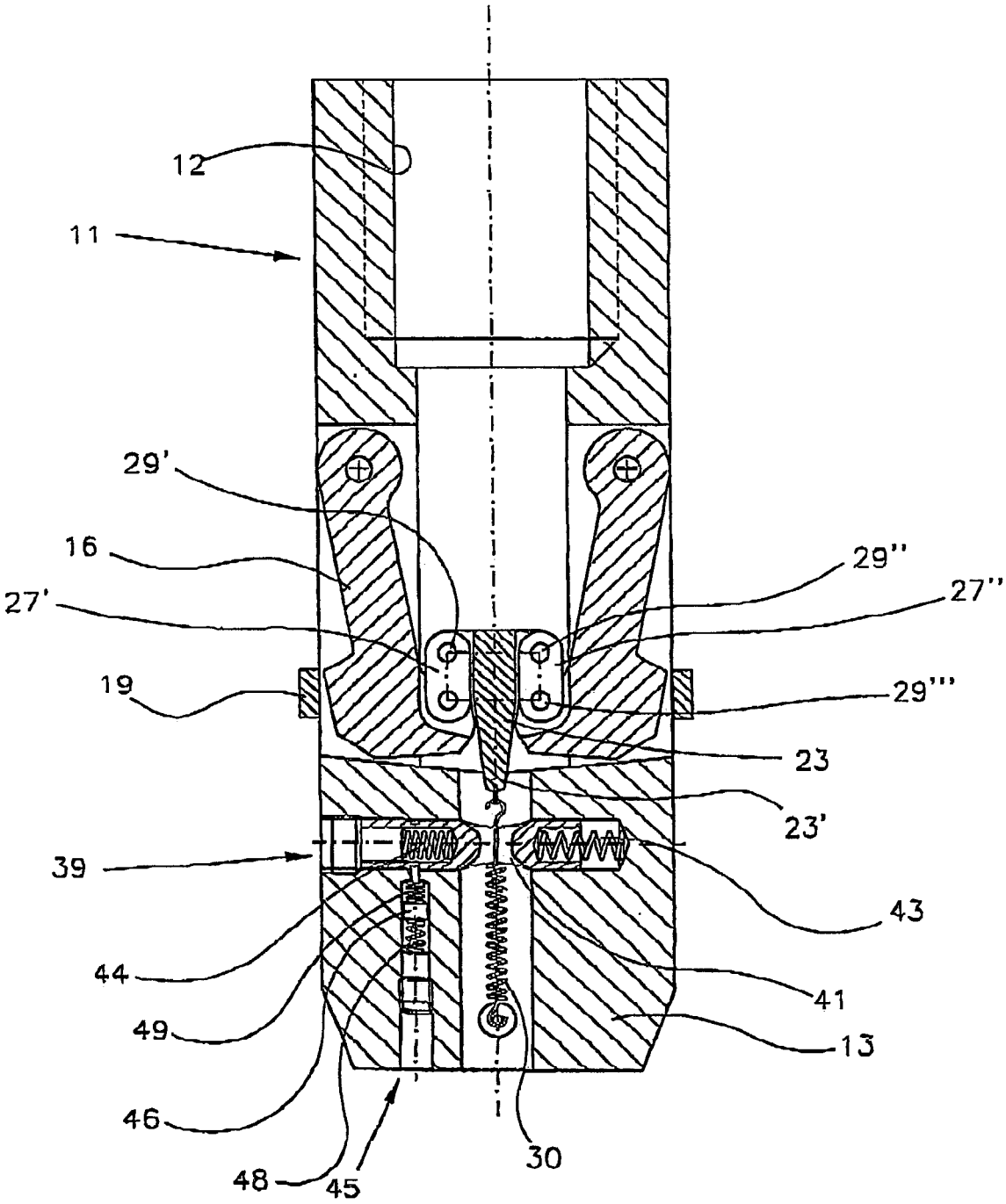
FIG. 13 shows, in a section, the coupling of FIG. 10 in the released state.

In another embodiment, see FIGS. 8 and 9, the floating element 36 is placed to the side of the inner part 11 of the coupling. The floating element 36 is connected to the locking body 23 through a wire 32 provided with a locking pin 33, in which there is arranged a locking groove 42 for the blocking spindle 40. The inner part 11 of the coupling is also provided with a spring 30 which forces the locking body 23 towards the locked position. On release the secondary release-blocking element 45 and the release-blocking element 39 are manoeuvred in the same way as described above in connection with FIGS. 2 and 3. The blocking spindle 40 is pulled out of the locking groove 42. The locking pin 33 on the wire 32 is thus released, and through the wire 32 the force of the floating element 36 overcomes the force of the spring 30, thereby carrying the locking body 23 out of its locked position, whereby the locking dogs 16 pivot inwards into their idle positions. This embodiment is well suited for use where the parts of the lifting equipment have a considerable angular deviation relative to the vertical direction.

In a further embodiment, see FIGS. 10 to 13, in addition to having a displacement in the axial direction of the coupling 3, the locking body 23 is arranged to have a rocking motion, as the locking body 23 is formed as a lever. The locking body 23 is hingingly connected to the chain links 27', 27" through link axles 29, 29', 29", 29'". Also in this embodiment the locking dogs 16 are locked in that the locking body 23 is positioned behind/between the locking dogs 16, thereby preventing them from pivoting inwards towards their unlocked positions. In this embodiment the blocking spindle 40 of the release-blocking element 39 is provided with a bore 41. In its locked position, one lever 23' of the locking body 23 is retracted in the bore 41 by a spring 30. See FIG. 10. The secondary release-blocking element 45 and the release-blocking element 39 are released as described above. The memory metal spring 44 displaces the blocking spindle 40 and thereby the bore 41 out of the centred position relative to the centre line of the coupling 3. See FIG. 11. The locking body 23 rotates about the first link axle 29' at the first chain link 27', thereby lifting the second link axle 29" of the second chain link 27" into a position above the opposite link axle of the second chain link 27". The force of the load, or for example of an annular spring 19, through the second chain link 27" now has, by the angle between an imaginary line through the link axles 29", 29'", of the second chain link 27" and the centre line of the coupling 3, a force component which acts on the locking body 23 in the direction towards the unlocked position. When the memory metal spring 44 is cooled, for example through convection to a surrounding medium, its force is reduced and the conventional spring 43 carries the blocking spindle 40 with the bore 41 back into the centred position. See FIG. 12. Thereby the locking body 23 will pivot on the second link axle 29" back into a centred position, whereby it lifts the first link axle 29' into the same axial position relative to the coupling 3, as that of the second link axle 29". Thereby the locking dogs 16 pivot inwards into the unlocked positions. See FIG. 13. The coupling is particularly suitable for applications, in which the coupling 3 is to be released while stressed.

Figure 14:
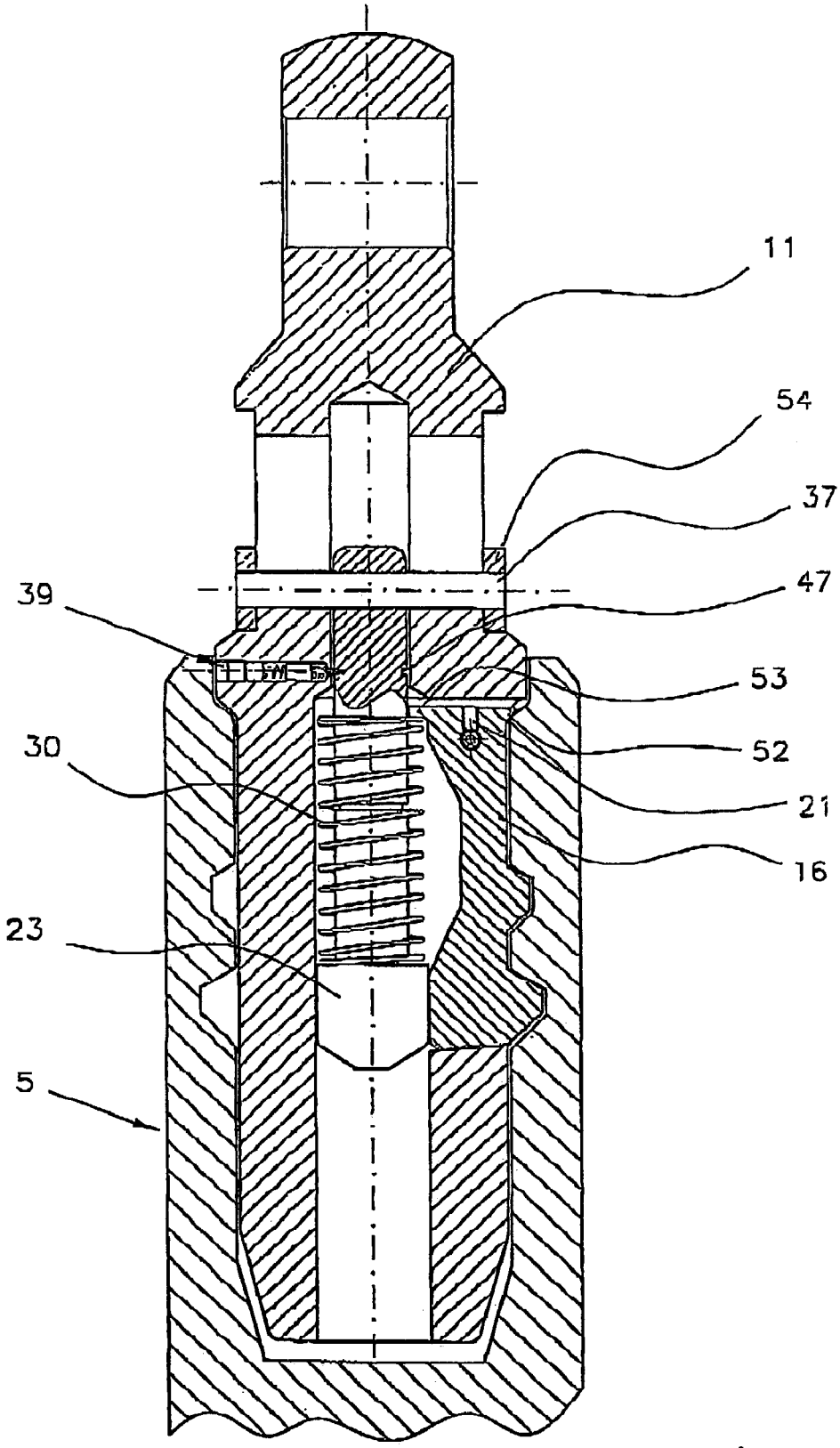
FIG. 14 shows, in a section, an embodiment of the invention in a multi-dog coupling for manual operation in its locked state.
Figure 15:
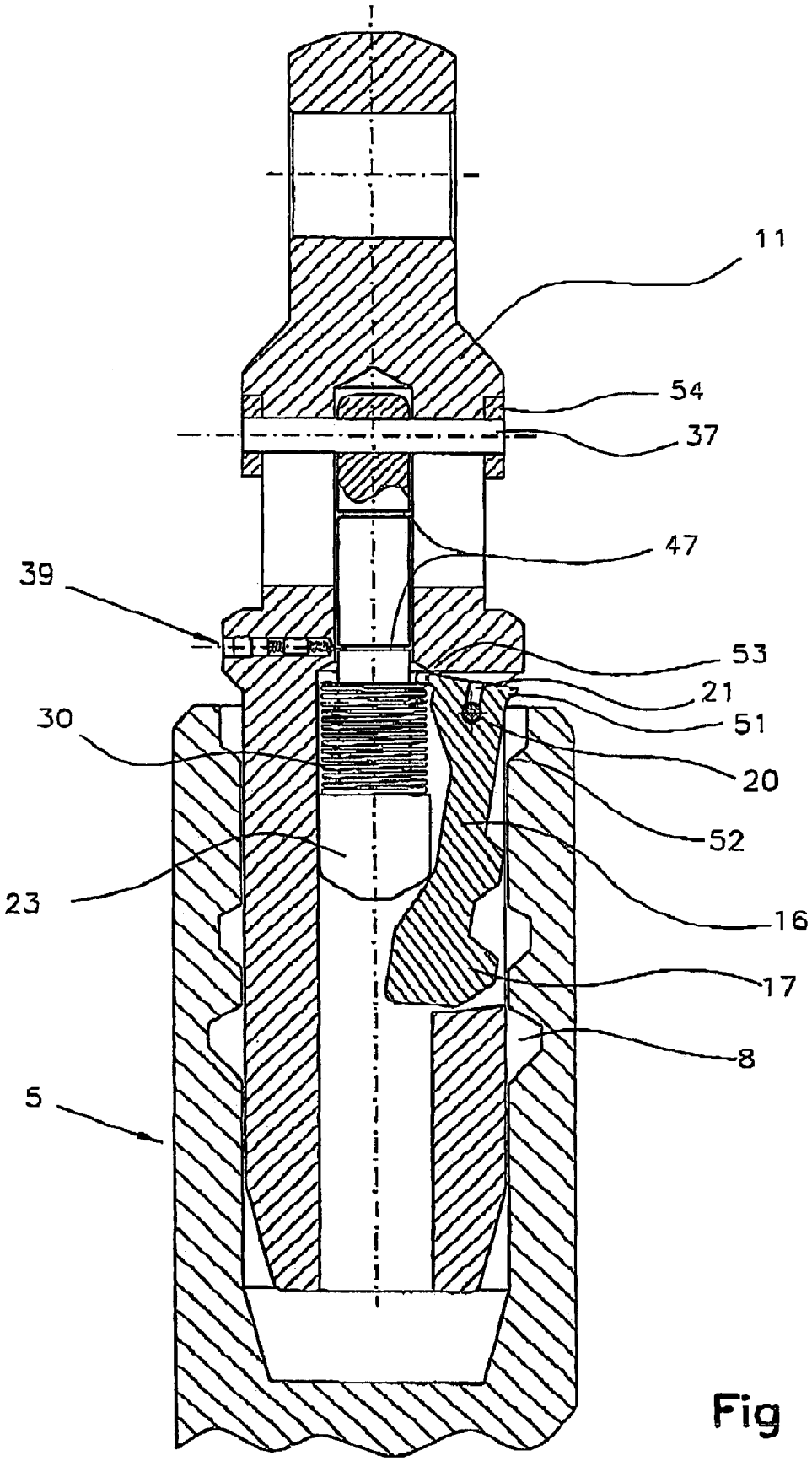
FIG. 15 shows, in a section, the coupling of FIG. 14, as it is released and the inner part 11 has partly been pulled out of the outer part 5.

In a further embodiment, see FIGS. 14 and 15, the locking dogs 16 are provided with a stop 51 which is arranged to meet, immediately before the inner part 11 of the coupling has been carried into its locking position in the outer part of the coupling, a shoulder 52 in the outer part 5 of the coupling. On further insertion the locking dogs 16 are brought to pivot outwards about the hinge shaft 20, so that the teeth 17 of the locking dogs 16 engage the countersunk hollows 8 of the outer part 5. A spring 30 spans between the locking body 23 and a lip 53. The spring 30 in thus arranged to displace the locking body 23 in the direction of its locked position, and the locking dogs 16 towards their idle positions, pivoted inwards. Through the axle 37 the locking body 23 is connected to a manoeuvring ring 54. On release of the coupling 3, the manoeuvring ring 54 is displaced manually upwards, whereby the locking body 23 is carried out of its locking position, the spring 30 is tightened and, as soon as the stop 51 is lifted from the shoulder 52, causes the locking dogs 16 to pivot inwards into their idle positions. In the locked position both end portions of the locking dog 16 bear on the locking body 23. By pushing the axle 37 out of the locking body 23 it is possible to force the locking body 23 downwards and out of its locked position.

The principles concerning the multi-dog coupling are not limited to the exemplary embodiments shown, as an inverted embodiment is conceivable, in which the locking dogs are arranged in the outer part of the coupling, or embodiments, in which the locking dogs are not positioned in a circular geometry.

The invention claimed is:

1. A releasable split coupling device provided with load-carrying releasable locking elements, the coupling device comprising:

an inner coupling part having at least one elongated locking arm that has an upper end that is suspended on a hinge shaft located within an oval shaped slot and a lower end that has a lower bearing surface, the locking arm being pivotable between a locked position and an unlocked position;

an outer coupling part having at least one countersunk hollow arranged to receive the inner coupling part;

wherein the locking arm comprises at least one tooth arranged to engage an interior surface of the outer coupling part when the locking arm is in the locked position;

a locking body arranged to position the locking arm into the locked position wherein the locking arm is prevented from pivoting out of the countersunk hollow, thus coupling the inner and outer coupling parts together, and into the unlocked position wherein the locking arm is free to pivot out of the countersunk hollow, thus allowing the inner and outer coupling parts to separate;

wherein in the locked position the lower bearing surface of the locking arm abuts against a bearing surface in the axial slot of the inner coupling part; and wherein in the unlocked position a clearance is defined between the lower bearing surface of the locking arm and the bearing surface in the axial slot of the inner coupling part;

wherein the oval shaped slot is sized larger than the diameter of the hinge shaft such that the locking arm is movable relative to the hinge shaft along the length of the oval shaped slot; and an adjustable member that extends into the oval shaped slot and against the hinge shaft, the adjustable member being positionable in a plurality of selected positions to adjust the position of the locking arm relative to the hinge shaft;

wherein adjustment of the position of the adjustable member further adjusts the clearance between the lower bearing surface of the locking arm and the bearing surface of the axial slot when the locking arm is in the unlocked position.

2. The device of claim 1, wherein the hinge shaft comprises opposing ends that are fixed and wherein the hinge shaft is free to bend in the oval shaped slot as a load is applied to the locking arm when it is in the locked position, thereby providing resiliency to the suspension of the locking arm on the hinge shaft as the locking arm moves out of the locked position.

3. The device of claim 1, wherein the adjustable member is a screw arranged to bear on the hinge shaft.

4. The device of claim 1, wherein the locking arm is coupled to the inner coupling part by a chain link and wherein pivoting action of the locking arm is restricted by rotation of the chain link.

5. The device of claim 1, wherein the inner coupling part comprises a plurality of locking arms.

6. The device of claim 1, wherein the locking body is caused to move from the locked position to the unlocked position by the buoyancy of a buoyant object.

7. The device of claim 1, further comprising a release blocking element and means for selectively positioning the release blocking element in the locked position to prevent the inner and outer coupling parts from separating, and the unlocked position to allow the locking elements to separate.

8. The device of claim 7, wherein the release blocking element comprises a spindle.

9. The device of claim 7, wherein the means for positioning the release blocking element comprise two opposed resilient springs.

* * * * *